US005111779A

United States Patent [19]

Kawamura

[11] Patent Number: 5,111,779

[45] Date of Patent: May 12, 1992

[54] ELECTROMAGNETIC VALVE ACTUATING SYSTEM

[75] Inventor: Hideo Kawamura, Koza, Japan

[73] Assignee: Isuzu Ceramics Research Institute Co., Ltd., Fujisawa, Japan

[21] Appl. No.: 571,527

[22] PCT Filed: Dec. 28, 1989

[86] PCT No.: PCT/JP89/01333

§ 371 Date: Aug. 28, 1990

§ 102(e) Date: Aug. 28, 1990

[87] PCT Pub. No.: WO90/07636

PCT Pub. Date: Jul. 12, 1990

[30] Foreign Application Priority Data

Dec. 28, 1988 [JP] Japan ..... 63-334958

[51] Int. Cl.[5] ..... F01L 9/04

[52] U.S. Cl. ..... 123/90.11; 251/129.01

[58] Field of Search ..... 123/90.11, 90.15; 251/129.01, 129.05, 129.09

[56] References Cited

U.S. PATENT DOCUMENTS 4,715,332 12/1987 Kreuter ..... 123/90.11
4,829,947 5/1989 Lequesne ..... 123/90.11

FOREIGN PATENT DOCUMENTS 2616481 12/1988 France ..... 123/90.11
183805 10/1983 Japan ..... 123/90.11
195004 11/1983 Japan ..... 123/90.11
162312 9/1984 Japan ..... 123/90.11
6012 1/1985 Japan ..... 123/90.11

*Primary Examiner*—David A. Okonsky
*Assistant Examiner*—Weilun Lo
*Attorney, Agent, or Firm*—Staas & Halsey

[57] ABSTRACT

An electromagnetic valve actuating system opens and closes intake and exhaust valves of an engine under electromagnetic forces generated by an electromagnet. A reciprocally movable magnetic pole (8*a*) is coupled to the stem end of an intake/exhaust valve (8). An upper fixed permanent magnet (3) confronts one end of the movable magnetic pole (8*a*) the direction in which it is reciprocally movable. The intake/exhaust valve is opened and closed under attractive and repelling forces acting between the movable magnetic pole (8*a*) and the upper fixed permanent magnet (3). Since the polarity of the movable magnetic pole can be changed depending on how the first coil (5), the second coil (6), and the third coil (7) are energized, the timing to open and close the intake/exhaust valve (8) can be varied depending on the operating condition of the engine (1).

10 Claims, 4 Drawing Sheets

ELECTROMAGNETIC VALVE ACTUATING SYSTEM

BACKGROUND OF THE INVENTION

1. Field of the Invention

The present invention relates to an electromagnetic valve actuating system for opening and closing intake and exhaust valves of an engine under electromagnetic forces generated by an electromagnet.

2. Description of the Related Art

Some conventional actuating systems for opening and closing intake and exhaust valves include a single camshaft which has cams to operate the intake and exhaust valves, the camshaft being disposed above or laterally by an engine. The camshaft is connected to the crankshaft of the engine by a belt or the like, so that the camshaft can rotate synchronously with the rotation of the engine. The valves have stems whose ends are pressed by cam surfaces of the camshaft through a link mechanism such as rocker arms or push rods. The intake and exhaust valves are normally closed by springs, and can be opened when their stem ends are pressed by the cam surfaces.

In an alternative actuating system, an intake camshaft having cams for acting on intake valves and an exhaust camshaft having cams for acting on exhaust valves are disposed above an engine. The intake and exhaust valves are opened when the stem ends of the intake valves are directly pushed by the cam surfaces of the intake camshaft and the stem ends of the exhaust valves are directly pushed by the cam surfaces of the exhaust camshaft.

However, the above conventional actuating systems for opening and closing intake and exhaust. valves have several problems. First, the conventional systems include camshafts and link mechanisms which must be added to the engine, and this necessarily renders the engine large in size.

Secondly, since the camshafts and the link mechanisms are driven by the output shaft of the engine, the engine output power is partly consumed due to the frictional resistance produced when the camshafts and the link mechanisms are driven by the engine. As a result, the effective engine output power is reduced.

Finally, the timing with which the intake and exhaust valves are opened and closed cannot be altered during operation of the engine, but the valve opening and closing timing is preset such that the engine operates with high efficiency only when it rotates at a predetermined speed. Therefore, the engine output power and efficiency are lower when the engine rotates at a speed different from the predetermined speed.

To solve the above problems, there have been proposed valve actuating systems for opening and closing intake and exhaust valves under electromagnetic forces from electromagnets, rather than with camshafts, as disclosed in Japanese Laid-Open Patent Publications Nos. 58-183805 and 61-76713.

However, the coils of the electromagnets disclosed in the above publications must be supplied with large electric energy in order to generate electromagnetic forces large enough to actuate the intake and exhaust valves. For this reason, the coils radiate a large amount of heat. As the electromagnets are associated with a cooling unit having a considerable cooling capacity, the problem of the large engine size still remains unsolved.

SUMMARY OF THE INVENTION

In view of the aforesaid problems, it is an object of the present invention to provide an electromagnetic valve actuating system for opening and closing intake and exhaust valves of an engine under electromagnetic forces from an electromagnet, rather than with a camshaft, the electromagnet being high in efficiency and output.

According to the present invention there is provided an electromagnetic valve actuating system in which a movable magnetic pole is coupled to an intake/exhaust valve. The movable magnetic pole has a first end and a second end an is reciprocally movable with the valve. An upper fixed permanent magnet confronts the first end of the movable magnetic pole. A first intermediate fixed magnetic pole, coupled to the upper fixed permanent magnet, confronts the upper fixed permanent magnet. A second distal fixed magnetic pole, coupled to the upper fixed permanent magnet, is and capable of confronting the first end of the movable magnetic pole when the valve is open. A distal fixed magnetic pole coupled to the second intermediate fixed magnetic pole confronts a side of the movable magnetic pole. A first coil generates a magnetic flux passing through the first intermediate fixed magnetic pole, a second coil generate a magnetic flux passing through the second intermediate fixed magnetic pole, and a third coil generates a magnetic flux passing through the movable magnetic pole.

The movable magnetic pole is attracted to the upper fixed permanent magnet to keep the intake/exhaust valve closed. To open the intake/exhaust valve, a magnetic path is produced between the movable magnetic pole and the second intermediate fixed magnetic pole, developing a repelling force acting between the upper fixed permanent magnet and the movable magnetic pole. To close the intake/exhaust valve, the movable magnetic pole is attracted again by the upper fixed permanent magnet.

The forces opening and closing the intake/exhaust valve are therefore rendered strong, and the actuating system may be reduced in size.

DESCRIPTION OF THE PREFERRED EMBODIMENT

An embodiment of the present invention will hereinafter be described in detail with reference to the drawings.

Figure 1:
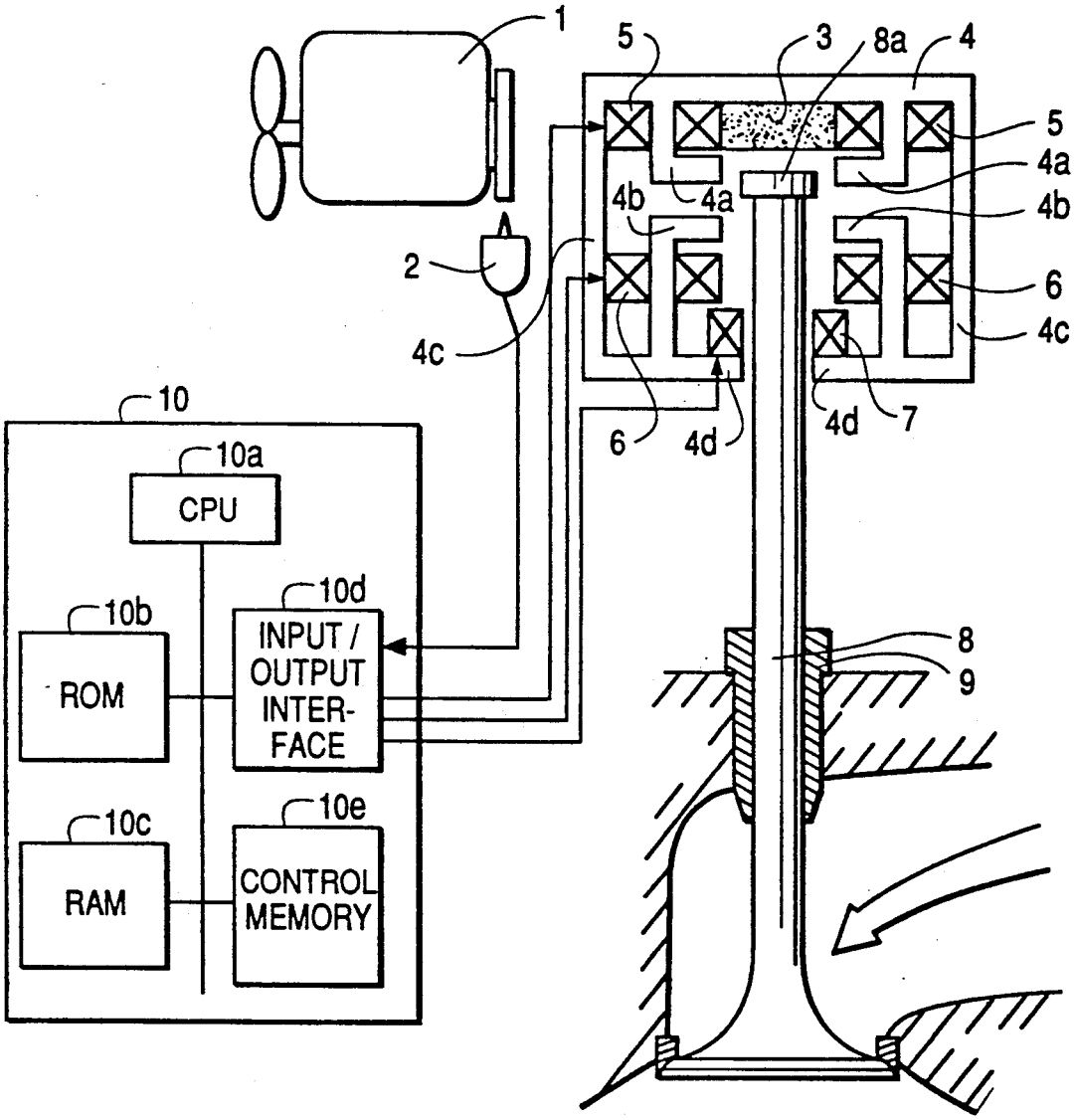
FIG. 1 is a block diagram showing an electromagnetic valve actuating system according to an embodiment of the present invention.
Figure 2:
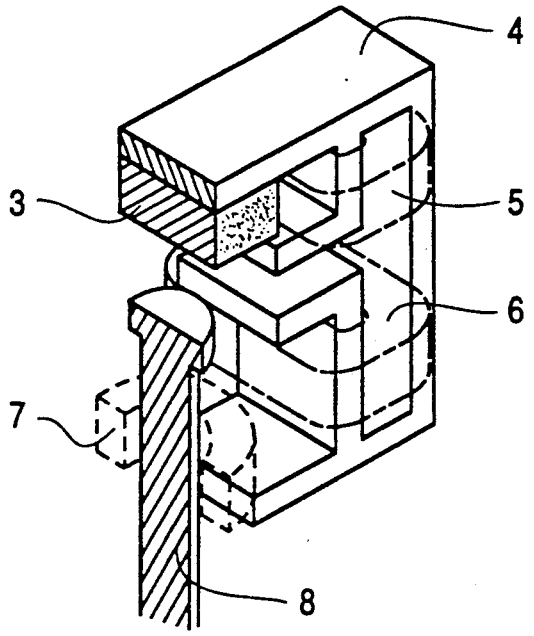
FIG. 2 is a perspective view showing a magnetic body and a valve in vertical cross section.

FIG. 1 is a block diagram showing an actuating system according to an embodiment of the present invention, and FIG. 2 shows in cross-sectional perspective an actuator of the actuating system.

In FIG. 1, an engine 1 has an output shaft, adjacent to which there is disposed a rotation sensor 2 for detecting the rotational speed and phase of the output shaft and converting the detected speed and phase into a signal. The engine 1 has intake and exhaust ports which are opened and closed by intake and exhaust valves, respectively. Of these intake and exhaust valves, the intake valve will mainly be described below.

An intake valve 8 is made of a magnetic material. The intake valve 8 is axially slidably supported by a valve guide 9. The intake valve 8 has a stem end 8*a* made of a magnetic material. The stem end 8*a* is confronted by a permanent magnet 3 which is connected to a central upper portion of a magnetic body 4.

The magnetic body 4 has first intermediate fixed magnetic poles 4*a* positioned on the lefthand and righthand sides of the permanent magnet 4, and second intermediate fixed magnetic poles 4*b* disposed below and confronting the first intermediate fixed magnetic poles 4*a*.

First coils 5 are disposed around the first left and right intermediate fixed magnetic poles 4*a*, and second coils 6 are also disposed around the second intermediate fixed magnetic poles 4*b*. The magnetic body 4 further has, in its lower portion, distal fixed magnetic poles 4*d* facing sides of the intake valve 8, and a third coil 7 through which the intake valve 8 is movable as a core.

The rotation sensor 2, the first coils 5, the second coils 6, and the third coil 7 are electrically connected to a control unit 12 by an input/output interface 12*d*. The control unit 12 includes, the input/output interface 12*d* which transmits output signals and receives an input signal, a ROM 12*b* for storing a program and data, a CPU 12*a* for effecting arithmetic operations under the control of the program stored in the ROM 12*b*, a RAM 12*c* for temporarily storing the input signals and the results of arithmetic operations, and a control memory 12*e* for controlling the flow of signals in the control unit 12.

Operation of the electromagnetic valve actuating system according to the present invention will be described below. FIGS. 3(*a*) through 3(*d*) show the flow of magnetic lines of force in the magnetic body 4. FIG. 3(*a*) shows the flow of magnetic lines of force when the valve is to be closed, FIG. 3(*b*) shows the flow of magnetic lines of force when the valve starts being opened from the closed condition, FIG. 3(*c*) shows the flow of magnetic lines of force when the valve remains open, and FIG. 3(*d*) shows the flow of magnetic lines of force when the valve starts being closed from the open condition.

In FIG. 3(*a*), the third coil 7 is energized to generate downward magnetic lines of force in the stem of the intake valve 8. The generated magnetic lines of force flow from the stem of the intake valve 8 to the distal fixed magnetic poles 4*d* and then through bypasses 4*c* to the permanent magnet 3.

Since the direction of the magnetic lines of force of the permanent magnet 3 is the same as the direction of the magnetic lines of force generated by the third coil 7, these magnetic lines of force are combined with each other, and flow through a magnetic path which extends from the stem end 8*a* of the intake valve 8 through the stem thereof back again to the distal fixed magnetic poles 4*d*.

When the magnetic lines of force flow from the permanent magnetic pole 3 to the stem end 8*a*, an S (south) pole is created on the stem end 8*a*. Therefore, attractive forces are produced between the N (north) pole of the permanent magnet 3 which faces the stem end 8*a*, pulling the intake valve 8 upwardly. In the position in which the head of the intake valve 8 contacts the valve seat, the intake valve 8 remains closed.

As shown in FIG. 3(*b*), when the crankshaft angle as detected by the rotation sensor 2 reaches the timing to open the intake valve 8, the third coil 7 is de-energized, and the second coils 6 are energized to generate downward magnetic lines of force in the second intermediate fixed magnetic poles 4*b*. The generated magnetic lines of force flow through a magnetic path which extends from the second intermediate fixed magnetic poles 4*b* to the distal fixed magnetic poles 4*d*, and then from the stem end 8*a* back to the second intermediate fixed magnetic poles 4*b*.

When the magnetic lines of force flow from the stem end 8*a* to the second intermediate fixed magnetic poles 4*b*, an N pole is created on the stem end 8*a* and S poles are created on the second intermediate fixed magnetic poles 4*b*.

Therefore, attractive forces are produced between the stem end 8*a* and the second intermediate fixed magnetic poles 4*b*, enabling the intake valve 8 to start moving in the opening direction.

As shown in FIG. 3(*c*), the intake valve 8 moves in the opening direction to the extent that the stem end 8*a* and the left and right second intermediate fixed magnetic poles 4*b* are lined up. In such an aligned condition, the gap between the stem end 8*a* and the second intermediate fixed magnetic poles 4*b* is minimum, and the attractive forces are maximum. Therefore, the speed at which the intake valve 8 moves in the opening direction is reduced, and the intake valve 8 is held in the condition shown in FIG. 3(*c*).

As shown in FIG. 3(*d*), when the crankshaft angle as detected by the rotation sensor 2 reaches the timing to close the intake valve 8, the second coils 6 are de-energized, and the first coils 5 are energized to generate downward magnetic lines of force in the first intermediate fixed magnetic poles 4*a*. The direction of the magnetic lines of force generated by the first coils 5 are the same as the direction of the magnetic lines of force generated by the permanent magnet 3, and these magnetic lines of force are combined and flow through the stem end 8*a* to the intake valve 8.

The magnetic lines of force flowing toward the intake valve 8 pass through a magnetic path extending through the distal fixed magnetic poles 4*d* and the bypasses 4*c* and branched to the first intermediate fixed magnetic poles 4*a* and the permanent magnet 3.

At this time, N poles are created on the face of the permanent magnet 3 facing the stem end 8*a* and the left and right first intermediate fixed magnetic poles 4*a*, and an S pole is created on the stem end 8*a*. Therefore, the intake valve 8 is attracted to the permanent magnet 3 and the first intermediate fixed magnetic poles 4*a*, thus starting to move in the closing direction.

Upon elapse of a first preset time from the timing to close the intake valve 8, the condition (*b*) is reached, when only the second coils 6 are energized. The intake valve 8 is now subjected to attractive forces, and its movement in the closing direction is decelerated. The intake valve 8 is thus decelerated in order to lessen shocks imposed when the head of the intake valve 9 is seated on the valve seat.

Upon elapse of a second preset time which is longer than the first preset time, the condition shown in FIG. 3(*a*) is reached when only the third coil 7 is energized to attract the intake valve 8 in the closing direction, thus closing the intake port. The intake valve 8 remains closed until the crankshaft angle of the engine reaches the next opening timing.

Figure 4:
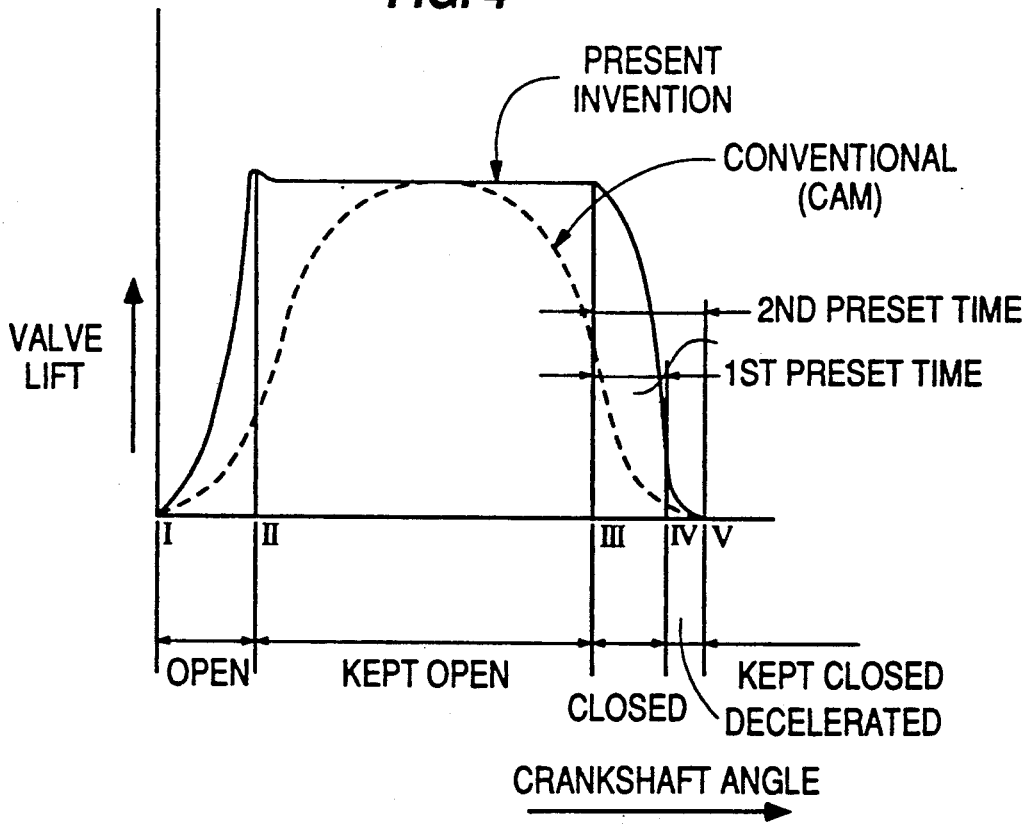
FIG. 4 is a diagram showing the relationship the crankshaft angle and the valve lift.
Figure 3A:
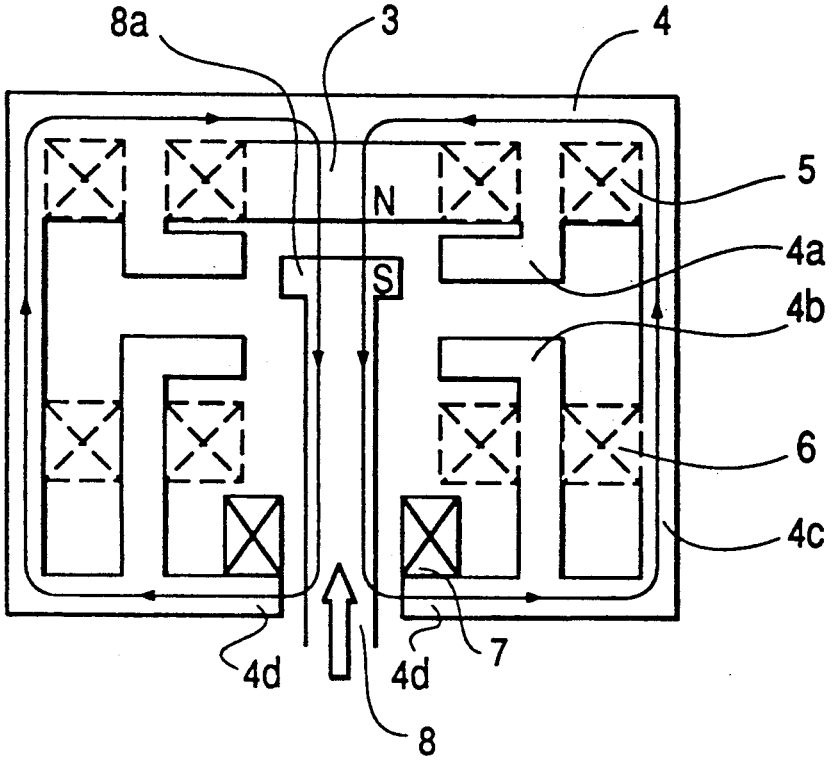
FIGS. 3(*a*) through 3(*d*) are diagrams showing the flow of magnetic lines of force within the magnetic body.
Figure 3B:
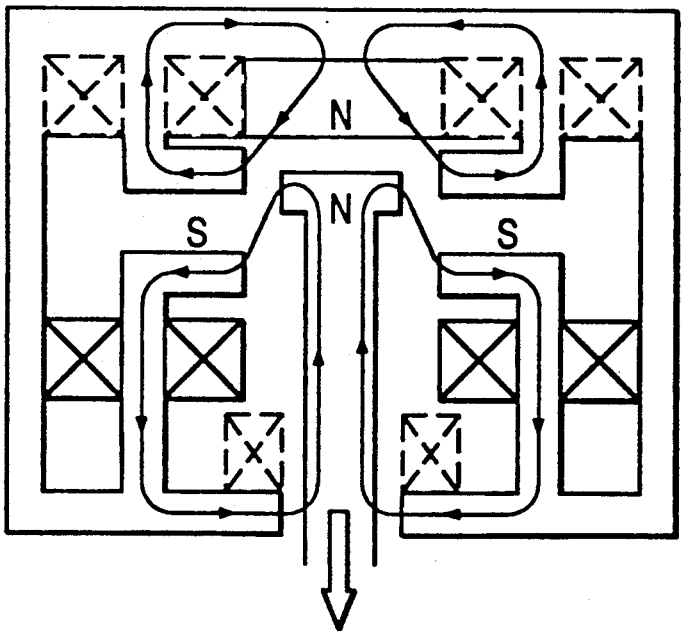
Figure 3C:
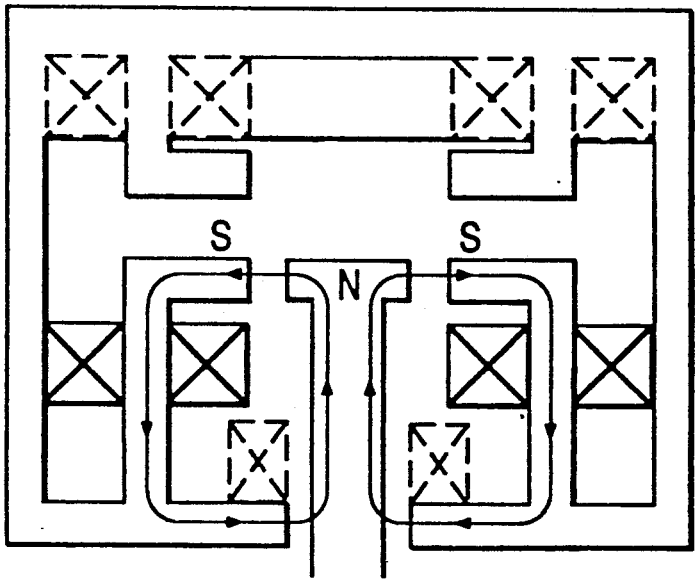
Figure 3D:
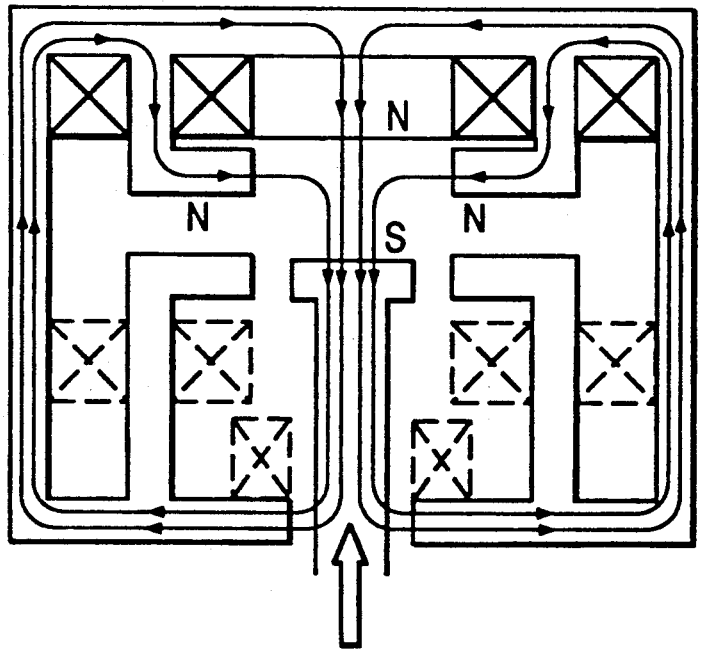

FIG. 4 shows a cam profile curve. The horizontal axis of the graph indicates the crankshaft angle of the engine, and the vertical axis indicates the valve lift which represents the distance by which the intake valve moves.

The curves in FIG. 4 show the manner in which the valve lift varies as the crankshaft angle varies. The solid-line curve represents changes in the valve lift in the actuating system according to the present invention. The broken-line curve represents changes in the valve lift in the conventional cam-operated actuating system.

At a time I which is the timing to open the intake valve 8, the third coil 7 is de energized, and the second coils 6 are energized to switch the flow of magnetic lines of force from the condition shown in FIG. 3(*a*) to the condition shown in FIG. 3(*b*). The intake valve 8 now moves in the opening direction, while being accelerated, to the position II in which the second intermediate fixed magnetic poles 4*b* and the stem end 8*a* are lined up.

When the position II is reached, the intake valve 8 is immediately stopped, and remains open until timing III to close the intake valve 8.

At the timing III, the flow of magnetic lines of force is switched from the condition shown in FIG. 3(*c*) to the condition shown in FIG. 3(*d*). Upon elapse IV of the first preset time, the flow of magnetic lines of force is switched from the condition shown in FIG. 3(*d*) to the condition shown in FIG. 3(*b*), decelerating the intake valve 8 in the closing direction. Upon elapse V of the second preset time, the flow of magnetic lines of force is switched from the condition shown in FIG. 3(*b*) to the condition shown in FIG. 3(*a*). The intake valve 8 now remains closed until next opening timing.

As shown in FIG. 4, the total opening area (over time) of the intake port, which is expressed as an area surrounded by the horizontal axis and the profile curve, is greater with the valve opening and closing operation of the present invention than with the conventional valve opening and closing operation. Therefore, any resistance to intake air is reduced, allowing intake air to be introduced quickly.

The first and second preset times are determined as follows: A table of preset times and engine rotational speeds is stored in advance in the ROM 12*b*, and a preset time corresponding to a certain engine rotational speed is determined from the table based on the engine rotational speed.

The ROM 12 may store a map of engine rotational speeds and valve opening and closing timing values I and III, so that the valve opening and closing timing may be varied as the engine rotational speed varies.

Furthermore, an engine cylinder control process for increasing or reducing the number of engine cylinders that are in operation depending on the rotational speed of the engine can be carried out.

The magnetically interrupted portions of the magnetic path, the distance between the distal fixed magnetic poles 4*d* and the intake valve 8 are small irrespective of whether the valve is opened or closed, and hence any leakage of magnetic lines of force from the magnetic path is small. Accordingly, the electromagnetic forces acting on the intake valve 8 is strong, with the result that the efficiency with which the electromagnetic forces are generated is increased, and the amount of heat generated by the coils is reduced.

While the intake valve has been described above, the actuating system of the present invention is also applicable to the exhaust valve, which is omitted from illustration.

Although a certain preferred embodiment has been shown and described, it should be understood that the present invention should not be limited to the illustrated embodiment but many changes and modifications may be made therein without departing from the scope of the appended claims.

As described above, the electromagnetic valve actuating system according to the present invention can be used as a system for actuating intake and exhaust valves of an engine, and suitable for use with an engine which is required to vary the timing to open and close the intake and exhaust valves freely depending on changes in an operating condition such as the engine rotational speed.

I claim:

1. An electromagnetic valve actuating system for opening and closing a valve, such as an intake and exhaust valve of an engine, comprising:

a movable magnetic pole coupled to the valve having a first and second end, said movable magnetic pole being mounted for reciprocating movement;

an upper fixed permanent magnet confronting said movable magnetic pole;

a first intermediate fixed magnetic pole coupled to said upper fixed permanent magnet and confronting said movable magnetic pole;

a second intermediate fixed magnetic pole coupled to said upper fixed permanent magnet and confronting the end of said movable magnetic pole when the valve is open;

a distal fixed magnetic pole coupled to said second intermediate fixed magnetic pole and confronting a side of said valve;

a first coil for generating a magnetic flux passing through said first intermediate fixed magnetic pole;

a second coil for generating a magnetic flux passing through said second intermediate fixed magnetic pole;

a third coil for generating a magnetic flux passing through said movable magnetic pole; and energization control means for energizing said first, second, and third coils to open and close said valve.

2. An electromagnetic valve actuating system according to claim 1, wherein said valve is made of a magnetic material.

3. An electromagnetic valve actuating system according to claim 1, wherein said energization control means applies a repelling force acting between said upper fixed permanent magnet and said movable magnetic pole before said valve is seated, thereby lessening shocks produced when the valve is seated.

4. An electromagnetic valve actuating system according to claim 1, wherein the timing established by said energization control means to open and close the valve is variable as the rotational speed of the engine varies.

5. A valve control system in an engine, comprising:

an electromagnet having coils and having fixed magnetic poles including an upper fixed pole, a distal fixed pole, and first and second intermediate fixed poles;

a valve having a magnetic stem end positioned in close proximity to said electromagnet; and control means for controlling movement of said valve by energizing and deenergizing the coils of said electromagnet at timings corresponding to a speed of the engine to attract the magnetic stem end to the upper fixed pole and first intermediate fixed pole, and to the distal fixed pole and second intermediate fixed pole, alternatively, to open and close said valve.

6. A valve control system according to claim 5, further comprising speed detection means for detecting a speed of the engine, and wherein said control means comprises a control unit including an input/output interface connected to said electromagnets and said speed detection means, a storage means for storing a table of the timings corresponding to different speeds of the engine, and a processor calculating the timings based on the speed detected by said detection means.

7. A valve control system according to claim 6, wherein said valve is upwardly and downwardly movable and is held open by energizing and deenergizing the coils.

8. A method of controlling a valve in an engine with an electromagnet having coils and surrounding the valve and having upper fixed, distal fixed, first and second fixed intermediate magnetic poles, and with a permanent magnet provided above the valve, comprising the steps of:

(a) providing the valve with a magnetic stem end in close proximity to the permanent magnet;

(b) detecting the speed of the engine;

(c) reading the speed of the engine into a computer; and (d) energizing and deenergizing the coils in the electromagnet to attract the magnetic stem end to the upper fixed pole and first intermediate fixed pole, and to the distal fixed pole and second intermediate fixed pole, alternatively, to open and close said valve, to move the valve upwardly and downwardly and hold the valve open at timings corresponding to the speed of the engine.

9. A method according to claim 8, wherein said energizing and deenergizing of the electromagnet in step (d) is performed at timings read by the computer from a preset speed timing table based on the speed.

10. A method according to claim 9, wherein step (d) includes the steps of:

(d1) holding the valve closed by energizing first coils of the coils to attract the magnetic stem end of the valve to the permanent magnet, (d2) opening the valve by deenergizing the first coils and energizing second coils of the coils to attract the magnetic stem end to poles of the electromagnet, (d3) holding open the valve by continuing deenergization of the second coils as in step (d2), and aligning the magnetic stem end with the poles, and (d4) closing the valve by deenergizing the second coils and energizing third coils of the coils to attract the magnetic stem end to the permanent magnet.

* * * * *